US007364531B2

(12) United States Patent
Chu

(10) Patent No.: US 7,364,531 B2
(45) Date of Patent: Apr. 29, 2008

(54) EXERCISING MACHINE PROVIDING LATERAL, SKATING-LIKE MOTION

(75) Inventor: Yong S. Chu, Glendale, CA (US)

(73) Assignee: Fitness Botics, Inc., Van Nuys, CA (US)

( * ) Notice: Subject to any disclaimer, the term of this patent is extended or adjusted under 35 U.S.C. 154(b) by 752 days.

(21) Appl. No.: 10/923,101

(22) Filed: Aug. 19, 2004

(65) Prior Publication Data

US 2005/0014613 A1 Jan. 20, 2005

Related U.S. Application Data

(63) Continuation-in-part of application No. 10/301,383, filed on Nov. 20, 2002, now Pat. No. 6,849,032.

(51) Int. Cl.
*A63B 21/00* (2006.01)
*A63B 23/04* (2006.01)

(52) U.S. Cl. ..... 482/51; 482/71

(58) Field of Classification Search ..... 482/51, 482/52, 57, 70, 79–80, 62
See application file for complete search history.

(56) References Cited

U.S. PATENT DOCUMENTS 3,650,528 A * 3/1972 Natterer ..... 482/71
3,707,283 A * 12/1972 Cormier ..... 482/71
4,340,214 A 7/1982 Schutzer
4,396,189 A * 8/1983 Jenkins ..... 482/71
4,781,372 A 11/1988 McCormack
4,869,496 A 9/1989 Colombo
4,915,373 A 4/1990 Walker
4,993,704 A * 2/1991 Luczynski ..... 482/70
5,284,460 A * 2/1994 Miller et al. ..... 482/51
5,342,264 A 8/1994 Gordon
5,391,130 A 2/1995 Green et al.
5,451,194 A 9/1995 Harrigan
5,520,598 A 5/1996 Little
5,595,554 A 1/1997 Maresh
5,692,995 A * 12/1997 Alvarez et al. ..... 482/71
5,718,658 A * 2/1998 Miller et al. ..... 482/71
6,042,511 A 3/2000 Bulloch
6,106,442 A * 8/2000 Tissue ..... 482/71
6,231,484 B1 * 5/2001 Gordon ..... 482/71
6,234,935 B1 * 5/2001 Chu ..... 482/51
6,849,032 B2 * 2/2005 Chu ..... 482/51
7,179,239 B2 * 2/2007 Chang ..... 601/90

* cited by examiner

*Primary Examiner*—Stephen R. Crow
(74) *Attorney, Agent, or Firm*—Gene Scott; Patent Law & Venture Group

(57) ABSTRACT

A lateral motion exercising apparatus provides a pair of vertically oriented axles engaged with a frame. A pair of support struts are rotationally engaged with the axles. A rigid link is pivotally joined at its terminal ends with the support struts in a manner for maintaining the support struts in parallel alignment as they rotate about the axles. A pair of platform struts is engaged pivotally at proximal ends of the support struts, the pivots enabling each of the platform struts to rotate vertically about its distal end. The proximal ends of the platform struts are constrained to move in opposing vertical motions in coordination with rotations of the support struts to produce a skating-like motion to a user standing on the platform struts.

7 Claims, 2 Drawing Sheets

EXERCISING MACHINE PROVIDING LATERAL, SKATING-LIKE MOTION

RELATED APPLICATIONS

This application is a Continuation-In-Part Application of a prior filed application having Ser. no. 10/301,383 and filing date of Nov. 20, 2002 now U.S. Pat. No. 6,849,032 and entitled: Exercise Apparatus Simulating Skating Motion.

INCORPORATION BY REFERENCE

Applicant hereby incorporates herein by reference, the following U.S. Pat. Nos. 4,340,214; 4,781,372; 4,915,373; 5,284,460; 5,342,264; 5,391,130; 5,451,194; 5,520,598; 5,692,995; 5718,658; 6,042,511; and 6,234,935.

BACKGROUND OF THE INVENTION

1. Field of the Invention

This invention relates generally to exercise machines and more particularly to such an exercise machine providing skating-type lateral motions for physical workout and exercising.

2. Description of Related Art

The following art defines the present state of this field:

Schutzer, U.S. Pat. No. 4,340,214 describes a training apparatus for skaters consisting of a fixed training stand with two carriages transversely displaceable in opposite directions, the displacement of which is controlled. Each carriage has a platform for the attachment of one of the skater's feet, said platform altering its angle of inclination upon displacement of the associated carriage from the initial position in the same way as a skate when cutting the ice. The lateral displacement of each carriage occurs against the action of a force which is adjustable.

McCormack, U.S. Pat. No. 4,781,372 describes an ice-skating leg exercise device utilizing in one embodiment a pair of rotatably positionable tracks each having a stirrup movable back and forth thereon in which the user's legs are positioned, each track being angularly adjustable with adjustable weight resistance provided against the rearward movement of each stirrup and a body support for the user to rest there against while exercising his legs on the device. Colombo, U.S. Pat. No. 4,869,496 describes a piece of equipment for the simulation of skiing movements which comprises a basic structure which can be stably placed on the ground. An arm is hinged to the basic structure in a median position and is able to oscillate horizontally. The arm carries a pair of boards at its end. Feet are connected to the structure to incline it with respect to the ground. The arm is able to carry out a slight vertical oscillation. The boards are restrained to the arm so that they can rotate around their vertical and horizontal axes, the rotation around the vertical axis being limited by suitable means. Two rods overhang and are connected to the arm by pins. The rods are able to rotate around the vertical axis of these pins, such rotation being made synchronous with that of the boards. The rotation is opposite to the direction of oscillation of the arm. The piece of equipment is also equipped with an electrical detection circuit which detects correct or incorrect movements carried out by the user who, by placing his or her feet on the boards and gripping the rods, gives an oscillating movement to the arm with the help of elastic devices which absorb and give back the kinetic energy produced, thus carrying out the movements required by skiing techniques.

Walker, U.S. Pat. No. 4,915,373 describes a power skating exercise device includes a pair of endless guide tracks, each of which have a power section and a return section and a pedal for each guide track. The pedal is mounted on a follower which is slidably mounted in one of the guide tracks. The follower is proportioned to pass freely along the return section. Drag is applied to the follower as it is driven along the drive section to resist the movement of the follower. A support frame is provided for supporting the user in a forwardly inclined semi-prone position which corresponds to the position assumed by a skater when accelerating forwardly.

Miller et al., U.S. Pat. No. 5,284,460 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

Gordon, U.S. Pat. No. 5,342,264 describes an aerobic exercise device which provides for a smooth, natural, orbital continuous motion of the user's feet. This device can be used for walking, running, jogging or stair-stepping exercises. Upper body workout devices can be provided with the aerobic exercise device such that a total body workout can be had. The device includes two parallel tracks with platforms. The platforms reciprocate along the tracks. A device is provided in each track for returning the platforms to the home position. As a user operates the device, he or she will push the platforms rearwardly. When the user's foot reaches the end of his or her stride, the user can then lift their foot in a natural motion. The device will return the platform to the home position. As the platform is returning to the home position, it will first travel in a forward direction and then switch to a rearward direction. This rearward movement will enable comfortable planting of the user's foot as it reengages the platform. The device can be easily accommodated to any desired workout level or to many different sized users.

Green et al., U.S. Pat. No. 5,391,130 describes an exercise apparatus used for leg exercises, and particularly for exercising the muscles used in ice skating. The apparatus has a frame with two four bar linkages arranged side by side. Each linkage carries a foot pad. A resistance unit is attached to each linkage to resist movement of the linkage in both directions. The resistance unit is preferably a double acting hydraulic cylinder connected to variable flow control valves to vary the resistance to linkage movement.

Harrigan, U.S. Pat. No. 5,451,194 describes a roller skate exercise device which consists of a platform having a top surface to support a pair of roller skates worn by a person. Components are for permitting the roller skates to slide in opposed reciprocating motions on the top surface of the platform, so as to simulate cross country skiing.

Little, U.S. Pat. No. 5,520,598 describes a combination leg exercise device, including: a base member; two, elongate, parallel plates attached to rotating apparatus mounted on the base member; and support apparatus disposed at distal ends of the plates to accommodate thereon selected weights; such that a person standing on the plates, with a foot disposed over each of the rotating apparatus, moves the weights between a first, lowered position and a second, elevated position by alternatingly flexing and relaxing muscles in the person's lower legs; the device further including: two track assemblies extending horizontally from the base member; and the track assemblies including thereon two wheeled platforms; such that a person standing with a foot on each of the platforms, slides the platforms back and forth along the track assemblies by alternatingly flexing and relaxing inner and outer muscles in the person's upper legs.

Alvarez et al, U.S. Pat. No. 5,692,995 describes an exercise machine that simulates the movements made during snow skiing and has a pair of foot support arms mounted for limited rotational movement about separate axes of rotation so that foot support portions of the foot support arms move simultaneously both vertically and horizontally, coordinates simultaneous movement of both foot support arms through a gear train coupling the foot support arms. In addition, foot support treads which support the feet of a user of the machine are resiliently mounted to the foot support arms to allow angling of the foot support treads to simulate a feeling of edging of skis.

Miller et al., U.S. Pat. No. 5,718,658 describes an apparatus and method for skate training exercise comprising arms of relatively long length pivotally mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electromagnetic, fly wheel-fan and weight stack.

Bulloch, U.S. Pat. No. 6,042,511 teaches an exercise, training and conditioning apparatus for skaters which includes a pair of movable foot platforms that are guided along a pair of coupled track sections, and a latching mechanism that alternatively secures and releases one of the pair of foot platforms while releasing and securing another one of the pair of foot platforms. According to one embodiment, the pair of track sections are coupled together at 90.degree. Resistance to movement is applied to the pair of foot platforms by elastic or inelastic cables.

Chu, U.S. Pat. No. 6,234,935 teaches a skating training apparatus includes rotating gears positioned in a generally horizontal plane. Linear supporting struts are pivotally attached to the gears for movement therewith and a motion restricting device is engaging with the liner supporting struts and adapted for restricting the linear supporting struts to a combination of pivotal and linear translational motion. Pivots engage the linear supporting struts and restrict it to pivotal motion at one end. Foot rests are mounted on the linear supporting struts at an end opposite to the pivots. The rotating gears, linear supporting struts, motion restricting device and pivots are mutually interconnected for moving the foot rests in a skating motion as driven by a person's feet while training on the apparatus.

Our prior art search with abstracts described above teaches various user supporting exercise machines including those that simulate a skater's motion. Alvarez et al, U.S. Pat. No. 5,692,995, teaches a machine that enables lateral motion with both feet moving in the same direction from side to side, and with the feet moving in opposing directions at the same time. However, Alvarez et al teaches a relatively expensive machine using gears to achieve coordinated motion. However, Alvarez et al and the prior art in general fails to teach the present simplified solutions for achieving similar motions as is defined in the following summary and detailed description accompanied by formal drawings illustrating the present invention.

SUMMARY OF THE INVENTION

The present invention teaches certain benefits in construction and use which give rise to the objectives described below.

A lateral motion exercising apparatus provides a pair of vertically oriented axles engaged with a frame for stability on a rest surface. A pair of support struts are rotationally engaged with the axles. A rigid link is pivotally joined at its terminal ends with the support struts in a manner for maintaining the support struts in parallel alignment as they rotate about the axles. A pair of platform struts is engaged pivotally to proximal ends of the support struts, the pivots enabling each of the platform struts to rotate vertically about its distal end. The proximal ends of the platform struts are constrained to move in opposing vertical motions in coordination with rotations of the support struts to produce a skating-like motion to a user standing on the platform struts.

A primary objective of the present invention is to provide an apparatus and method of use of such apparatus that yields advantages not taught by the prior art.

Another objective of the invention is to provide a machine of relatively simple construction that provides the complex motion of the skater.

A further objective of the invention is to provide such a machine capable of moving user supports for both feet in the same direction simultaneously from side to side while one foot moves vertically in the opposing direction of the other foot.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

Figure 1:
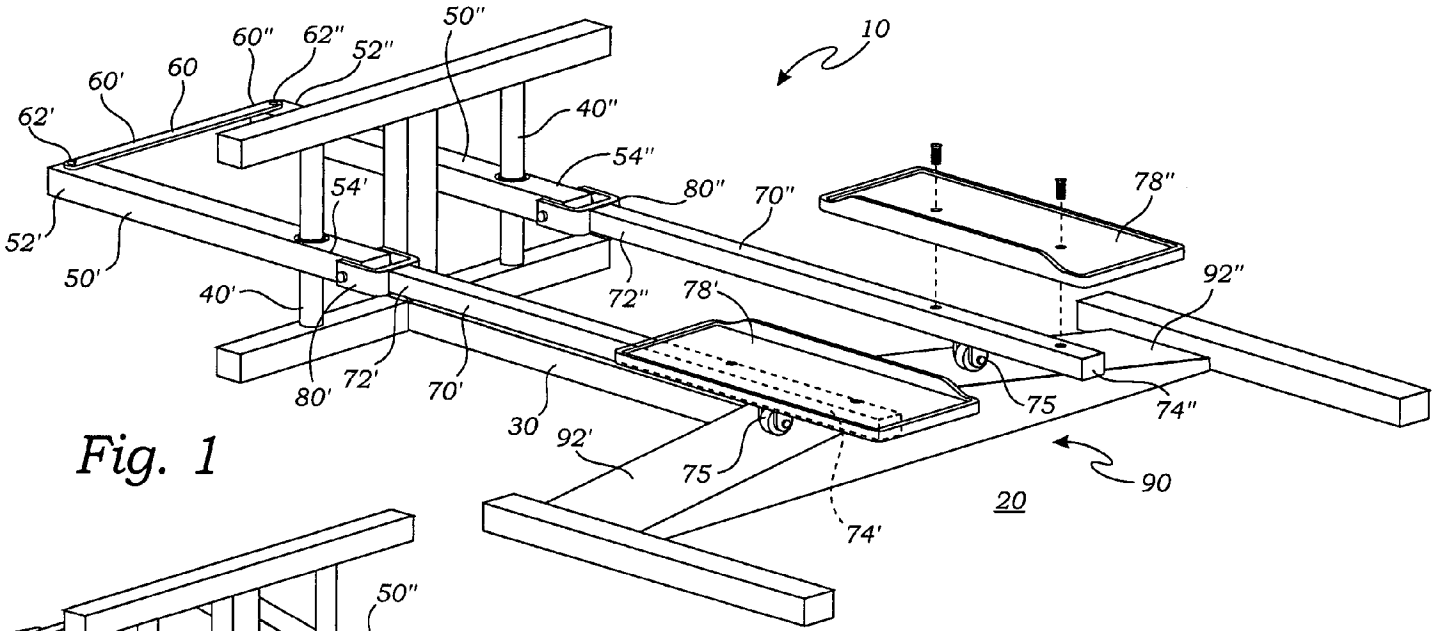
FIGS. 1 and 2 are perspective views of one embodiment of the present invention showing support platforms of the invention in a neutral position and in a laterally displaced position respectively.

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

A lateral motion exercising apparatus 10 rests on a support surface 20 such as the floor of a gymnasium, workout room, or similar place for sport and exercise. The apparatus 10 provides a frame member 30 and a pair of vertically oriented and spaced-apart axles 40' and 40". Each one of the axles 40' and 40" is engaged at a lower end with the frame member 30 thereby securing the axles 40' and 40" in rigid upright extension from the frame member 30. A pair of support struts 50' and 50" is each rotationally engaged with one of the axles 40' and 40" and thus free to rotate about the axles 40' and 40". This may be facilitated by a bearing engagement for instance. A first link 60 is pivotally joined (pivots 62' and 62") at its terminal ends 60' and 60" with distal ends 52' and 52" of support struts 50' and 50" respectively in a manner for maintaining the support struts 50' and 50" in alignment as the support struts 50' and 50" rotate about the axles 40' and 40" respectively. The first link 60 may be a rigid rod, as shown in the figures, or it may be a crank, plural interconnected rods, or any mechanical arrangement that maintains a desired relationship between the distal ends of support struts 50' and 50". A pair of platform struts 70' and 70" are each engaged at a distal end 72' and 72" respectively, thereof by one of a pair of pivots 80' and 80" respectively, to a proximal end 54' and 54" of one of the support struts 50' and 50". The pivots 80' and 80" are constructed to enable each of the platform struts 70' and 70" to rotate only in the vertical direction about the distal end 72' and 72" thereof. A means for constraining 90 of the proximal ends 74' and 74" respectively of the platform struts 70' and 70" is enabled so that the proximal ends 74' and 74" of platform struts 70' and 70" move in opposing vertical motions in coordination with rotations of the support struts 50' and 50" respectively. Such a constraining means 90 may be any mechanical equivalent to the embodiments shown herein, whereby the motion of the platform struts 70' and 70" is perfected as described herein, but the axles 40', 40" but be oriented in parallel alignment, albeit, they may be oriented in the vertical or off-vertical in any selected direction. Preferably, the platform struts 70' and 70" engage foot supports 78' and 78" as shown, and it is on these foot supports that the user stands to exercise.

Figure 2:
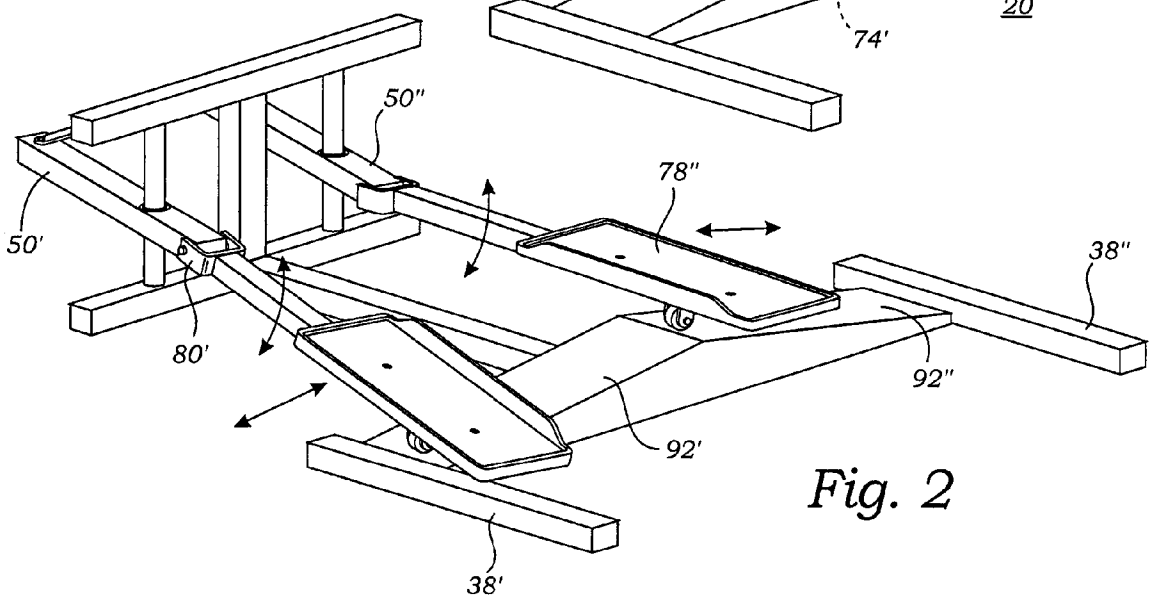

In one embodiment of the present invention, each one of the platform struts 70' and 70" provides a wheel 75 attached thereunder. The constraining means 90 comprises a pair of inclined planes 92' and 92" which are positioned and oriented so as to support the platform struts 70' and 74" respectively for rolling thereon with wheels 75. It is seen in FIGS. 1 and 2 that the proximal ends 74' and 74" move in opposing vertical directions as they move together in the same lateral direction in cyclic motion. Motion enablement is shown by arrows. The frame member 30 provides cross member 34, and upper carriage member 32 (FIG. 3) for securing axles 40' and 40". Forward stabilizers 38' and 38" are secured at the outer edges of the planes 92' and 92" respectively.

Figure 3:
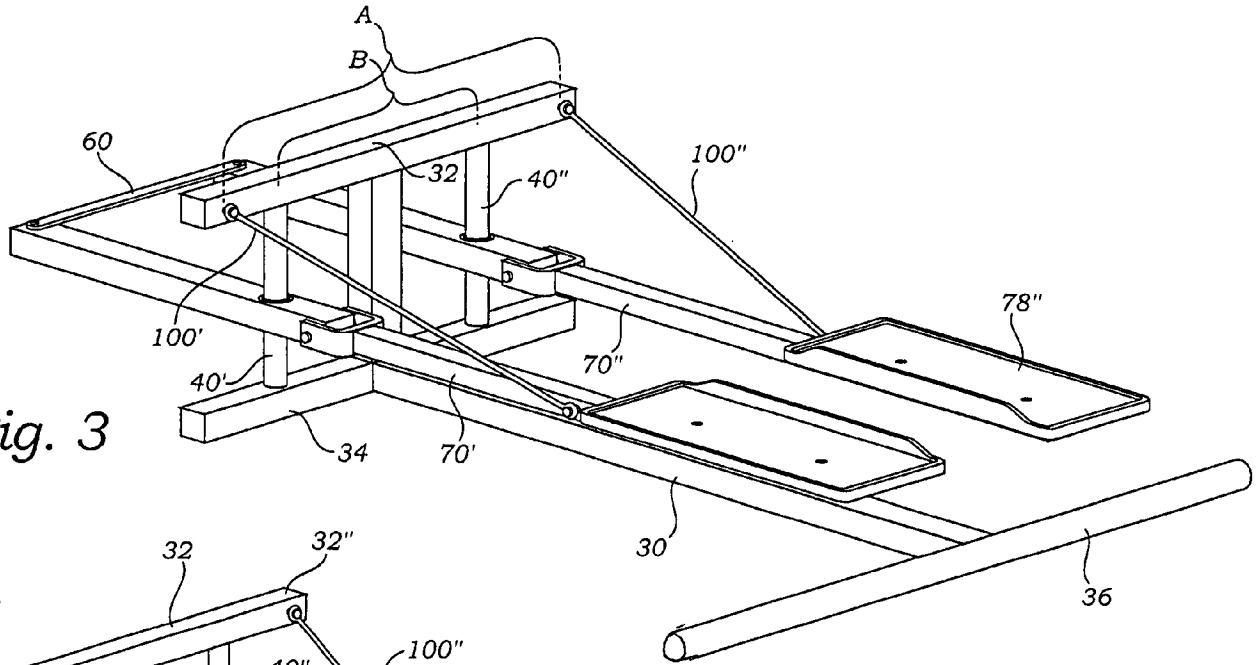
FIGS. 3 and 4 are perspective views of a further embodiment of the present invention, again, showing the support platforms of the invention in the neutral position and in the laterally displaced position respectively.
Figure 4:
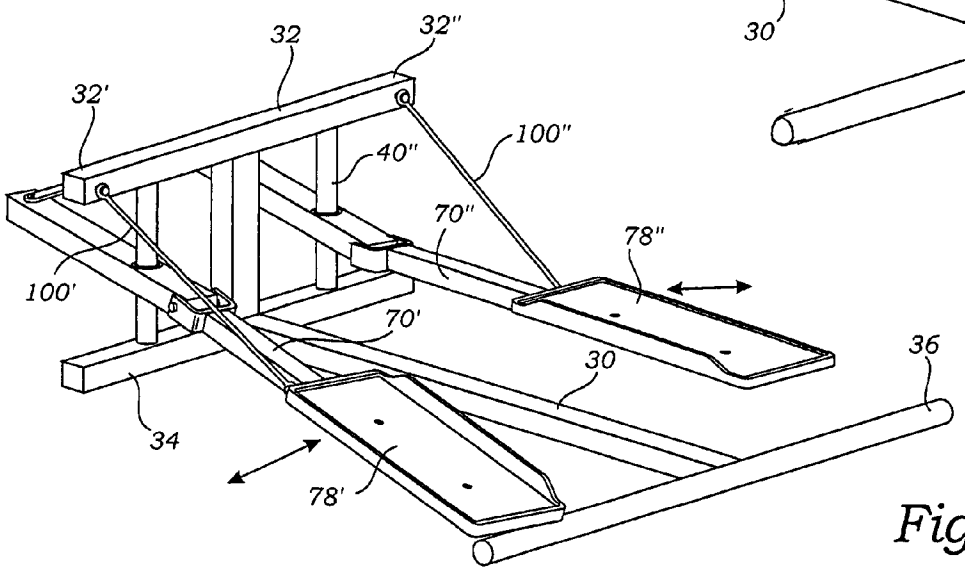

In a further embodiment of the present invention, the constraining means 90 is a pair of second links 100' and 100", which may be cables as shown or rigid bars, for instance. Each one of the second links 100' and 100" joins one of the platform struts 70' and 70" respectively, with the frame member 30 as shown in FIGS. 3 and 4. In this case, the frame member 30 is constructed to have a upper carriage 32 located above the platform struts 70' and 70", and it is the links 100' and 100" that support the struts 70', 70" as they move laterally in cyclic motion. It is noted that the upper carriage 32 is positioned horizontally and laterally in the frame member 30, and its length is such that the links 100' and 100" are able to be joined with upper carriage 32 at positions that are wider apart then the spacing of axles 40' and 40". See brackets "A" and "B" in FIG. 3, where this relationship is illustrated. It is because of this wide stance that when support struts 70', 70" move to one side, the support strut that is on the outside position moves downwardly, while the strut on the inside position moves upwardly. FIG. 4 shows that strut 70' and thus foot support 78' is moved to a lower position by virtue of the lateral movement shown, while the reverse is true of foot support 78". As in the first embodiment described above, the frame member 30 provides cross member 34, and upper carriage member 32 for securing axles 40' and 40". Forward stabilizers 38' and 38" are replaced in this embodiment by transverse bar 36 which provides stability to the frame, as does cross member 34.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A lateral motion exercising apparatus for resting on a support surface, the apparatus comprising: a frame member engaging a pair of spaced-apart axles of spacing distance B;

a pair of support struts, each rotationally engaged with one of the axles; a link pivotally joined with the support struts thereby maintaining the support struts in rotational alignment about the axles; a pair of platform struts, each of the platform struts pivotally engaging one of the support struts, thereby enabling vertical rotation of the platform struts; and a means for constraining the platform struts to move in opposing vertical directions coordinated with cyclic non-opposing horizontal motion.

2. The apparatus of claim 1 wherein each one of the platform struts provides a wheel engaged thereunder; the constraining means comprising a pair of inclined planes positioned and oriented so as to support the platform struts for rolling thereon and thereby enabling the platform struts to move in non-opposing horizontal motion with opposing vertical motion.

3. The apparatus of claim 1 wherein the constraining means is a pair of second links; each one of the second links joining one of the platform struts with the frame member thereby enabling the platform struts to move in non-opposing horizontal motion with opposing vertical motion.

4. The apparatus of claim 3 wherein the second links engage an upper carriage of the frame member in positions spaced apart by distance A, wherein distance A is greater than distance B.

5. A lateral motion exercising apparatus for resting on a support surface, the apparatus comprising: a frame member engaging a pair of spaced-apart axles of spacing distance B; a pair of support struts, each rotationally engaged with one of the axles; a link pivotally joined with the support struts thereby maintaining the support struts in rotational alignment about the axles; a pair of platform struts, each of the platform struts pivotally engaging one of the support struts, thereby enabling vertical rotation of the platform struts; and a means for constraining the platform struts to move in opposing vertical directions coordinated with cyclic non-opposing horizontal motion, the constraining means comprising a pair of inclined planes positioned and oriented so as to support the platform struts for rolling thereon in non-opposing horizontal motion with opposing vertical motion.

6. A lateral motion exercising apparatus for resting on a support surface, the apparatus comprising: a frame member engaging a pair of spaced-apart axles of spacing distance B; a pair of support struts, each rotationally engaged with one of the axles; a first link pivotally joined with the support struts thereby maintaining the support struts in rotational alignment about the axles; a pair of platform struts, each of the platform struts pivotally engaging one of the support struts, thereby enabling vertical rotation of the platform struts; and a means for constraining the platform struts to move in opposing vertical directions coordinated with cyclic non-opposing horizontal motion, wherein the constraining means is a pair of second links; each one of the second links joining one of the platform struts with the frame member in such manner as to enable the platform struts to move in non-opposing horizontal motion with opposing vertical motion.

7. The apparatus of claim 6 wherein the second links engage an upper carriage of the frame member in positions spaced apart by distance A, wherein distance A is greater than distance B.

* * * * *